US008468868B1

(12) United States Patent
Garrett, Jr.

(10) Patent No.: US 8,468,868 B1
(45) Date of Patent: Jun. 25, 2013

(54) BUCKING BAR DEVICES AND METHODS OF ASSEMBLING BUCKING BAR DEVICES

(75) Inventor: David L. Garrett, Jr., St. Louis, MO (US)

(73) Assignee: The Boeing Company, Chicago, IL (US)

( * ) Notice: Subject to any disclaimer, the term of this patent is extended or adjusted under 35 U.S.C. 154(b) by 345 days.

(21) Appl. No.: 12/830,653

(22) Filed: Jul. 6, 2010

(51) Int. Cl.
*B21J 15/32* (2006.01)

(52) U.S. Cl.
USPC ..... 72/466.5; 72/453.17; 72/453.19; 72/476; 29/243.53

(58) Field of Classification Search
USPC ..... 72/453.17, 453.19, 466.4, 466.5, 72/479, 481.2, 476; 470/191; 29/243.521, 29/243.53
See application file for complete search history.

(56) References Cited

U.S. PATENT DOCUMENTS 2,512,532 A * 6/1950 Sargent et al. ..... 72/466.5
4,380,923 A 4/1983 Emmerich
4,398,411 A 8/1983 Emmerich
4,450,921 A 5/1984 Arvidsson et al.
4,676,422 A 6/1987 Gidlund et al.
4,885,836 A * 12/1989 Bonomi et al. ..... 29/243.54
5,269,381 A 12/1993 Oscarsson
5,379,508 A 1/1995 Givier et al.
5,572,900 A 11/1996 Ayeni
5,577,315 A 11/1996 Givier
5,588,323 A 12/1996 Peterson
5,953,952 A * 9/1999 Strickland ..... 72/466.9
6,088,897 A 7/2000 Banks et al.
6,134,940 A 10/2000 Banks et al.
6,279,371 B1 8/2001 Brewer
6,363,768 B1 4/2002 Earls et al.
6,820,319 B2 11/2004 Heck et al.
6,823,709 B2 11/2004 Dowell et al.
6,961,982 B1 11/2005 Heck et al.
6,961,983 B1 11/2005 Heck et al.
7,243,525 B2 7/2007 Galluzo

OTHER PUBLICATIONS

Chinatungsten Online (Xiamen) Manu. & Sales Corp.; http://www.buckingbar.com.cn/bucking_bar_work.htm; Copyright 2000-2009; 3 pages.
Integrated Publishing-Aviation; http://www.tpub.com/content/aviation/14018/css/14018_523.htm; 3 pages, 2010.
Heintz, C.; Riveted Joints Part 1 of 2; Zenith Aircraft Company; http://zenithair.com/kit-dataiht-86-12.html; Dec. 1986; 4 pages.
Richards, S.; Notes on Good Riveting; Vansairforce.net; http://www.vansairforce.net/articles/NotesOnRiveting/NotesOnRiveting.htm; 6 pages, 2010.
Unbeatable System for Vibration Damping; Atlas Copco-Riveting Systems for Quality Results; Sweden 1998; 3 pages.

* cited by examiner

*Primary Examiner* — Teresa M Ekiert
(74) *Attorney, Agent, or Firm* — Armstrong Teasdale LLP

(57) ABSTRACT

Bucking bar devices, and methods of assembling bucking bars devices, for use in riveting parts together are described. In one example embodiment, the bucking bar device includes a bucking bar and a sleeve positioned so that the bucking bar extends within the sleeve. One end of the sleeve is configured to be positioned adjacent to at least one of the parts.

14 Claims, 14 Drawing Sheets

BUCKING BAR DEVICES AND METHODS OF ASSEMBLING BUCKING BAR DEVICES

BACKGROUND OF THE DISCLOSURE

This disclosure relates generally to riveting operations, and more specifically to the formation of consistent rivet joints.

Hand, or manual, riveting operations are commonly performed in connection with many different assembly processes. For example, in connection with assembly of an aircraft, hand riveting is performed in connection with forming many different joints. In performing a manual riveting operation, an operator inserts a shaft of a rivet through aligned openings of the materials to be joined. The operator pushes the rivet shaft through the aligned openings until a head of the rivet rests against a material surface. The operator then presses a riveting tool, e.g., an air hammer, into contact with the rivet head, and holds a bucking bar against an end of the shaft, sometimes referred to as a buck tail. Then operator activates the air hammer, which causes the tail to deform, or buck, against the bucking bar. Such process sometimes is referred to as bucking. Consistently manually forming solid rivet joints as described above is dependent on the skill of the operator.

Generally, buck tails are compressed to within a defined range with specific tolerances. The defined range and specific measured tolerances may vary from application to application, and can be empirically determined. If the buck tail is not sufficiently compressed, i.e., under compressed, to within the defined range and tolerances for a specific operation, then additional bucking may be performed. If the buck tail is over compressed, then the rivet typically is removed and a new rivet operation is performed. Such rework of under compressed and over compressed rivets adds costs and time to forming rivet joints.

When forming a rivet joint between components, typically there are no gaps between the surfaces of the components being joined. Generally, the surfaces are held in tight contact by the compressed rivets. Frequent checks may be conducted to locate any gaps. If a gap does exist, the components may be forced together by other manual operations. In some instances, it is possible that there are significant gaps, in which case the rivets may need to be removed and the entire joint reformed. Such gaps can result from numerous different causes, such as if the bucking bar is not fully aligned with the buck tail during bucking. As with the rework for under compressed and over compressed rivets, the work associated with eliminating gaps also adds costs and time to forming rivet joints Since the operator typically holds the bucking bar in one hand when performing a manual rivet operation, the operator is subject to the vibration associated with the bucking operation. The operator may wear impact gloves or use a padding material on the bucking bar to reduce the vibrations transmitted from the bar to the operator. Also, at least some known bucking bars are air damped, to facilitate reducing vibration forces acting on the operator.

BRIEF DESCRIPTION

In one aspect, a bucking bar device for use in riveting parts together is described. In one embodiment, the bucking bar device includes a bucking bar, and a sleeve positioned so that the bucking bar extends within the sleeve. One end of the sleeve is configured to be positioned adjacent to at least one of the parts.

In another aspect, a sleeve for use with a bucking bar device including a bucking bar is described. The sleeve includes a cylinder engaging sleeve member having threads on an internal surface, and an intermediate sleeve member having threads on an outer surface. The intermediate sleeve member is in threaded engagement with the cylinder engaging sleeve member. A non-marring sleeve member is at least partially inserted into the intermediate sleeve member and extends therefrom.

In yet another aspect, a method for installing a rivet is provided. The method includes the steps of setting a recess between an impact face of a bucking bar device and a reference surface of a bucking bar sleeve assembly operatively attached to the bucking bar device to form a bucking bar and sleeve assembly, placing an end surface of the bucking bar sleeve assembly around a buck tail of the rivet to be set and against the surface of the material to be riveted, and compressing the buck tail of the rivet using the bucking bar and sleeve assembly until the impact face of the bucking bar no longer impacts the buck tail of the rivet.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION

Example embodiments of bucking bar sleeves for use with handheld air damped bucking bar devices are described herein. Such sleeves are not limited to use with any one particular bucking bar device, nor are such sleeves limited to use with just air damped bucking bar devices. In addition, and rather than being constructed as a separate sleeve, it is contemplated that the sleeve can be integrated into the bucking bar device. Further, the bucking bar sleeves sometimes are described herein in the context of an aircraft. Such bucking bar sleeves are not limited to use in any one particular riveting application, and can be used in many different applications.

The bucking bar sleeve described herein is adjustable and engages to a known air damped bucking bar device. The sleeve facilitates assuring a desired compression of a rivet buck tail during a riveting operation, avoiding formation of gaps between parts, and providing bar balance and vibration control for operators. More particularly, and as described below in more detail, in one embodiment the bucking bar sleeve includes an adjustable, encircling, non-marring reference surface that limits the degree of compression of the buck tail. The non-marring surface also controls an even compression across the end of the rivet. The relative position of the non-marring surface with respect to the bucking bar can be adjusted to allow a desired amount of compression of the buck tail. The sleeve therefore removes at least some dependency on the skill and experience of the operator, and facilitates avoiding variation and rework.

Figure 1:
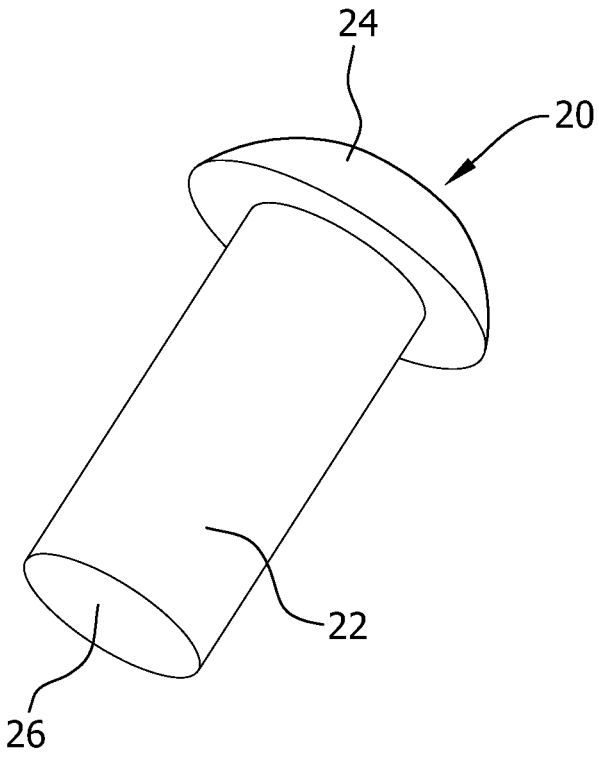
FIG. 1 is a perspective view of a rivet.

FIG. 1 is a perspective view of a solid rivet 20. In the example embodiment, rivet 20 is fabricated from aluminum alloys. Rivet 20 could be fabricated from many different types of materials, and many different types of rivets of different sizes, dimensions, materials, and construction (e.g., semi-tubular) can be used in connection with the bucking bar sleeve described herein. For example, in aircraft applications, rivets typically are fabricated from aluminum alloys, titanium, and nickel-based alloys, and the rivet material selected depends on the particular stresses and forces in the particular fastening application.

Rivet 20 includes a shaft 22 and a head 24. An end 26 of shaft 22 sometimes is referred to as a buck tail 26. In riveting operations, buck tail is deformed, or bucked, so that it expands to a cross sectional shape greater than the original shaft diameter.

Figure 2:
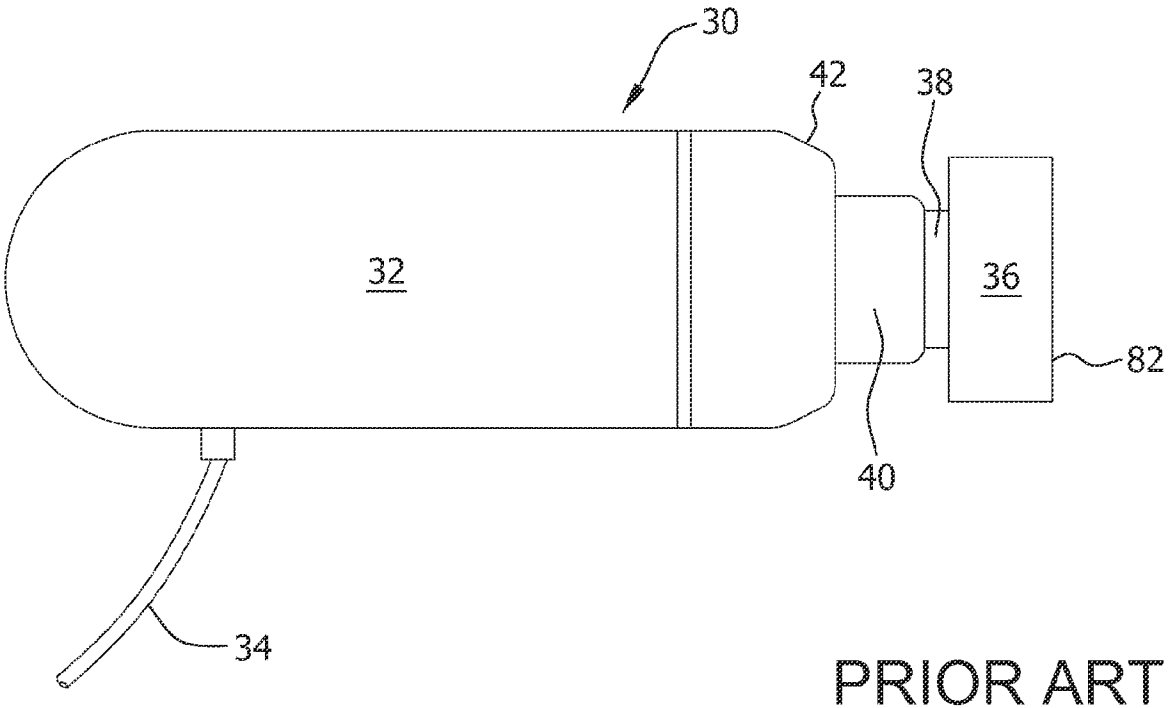
PRIOR ART FIG. 2
FIG. 2 is a side view of a known air damped bucking bar.

FIG. 2 is a side view of a known handheld air damped bucking bar device 30. Such bucking bar device 30 is commercially available from Atlas Copco Tools and Assembly Systems, LLC, 2998 Dutton Road, Auburn Hills, MI 48326. Bucking bar device 30 includes an air cylinder 32 coupled to an air line 34. A bucking bar 36 extends from air cylinder 32, and includes a shaft 38 that extends through a cylinder collar 40 and into a tight fit with cylinder 32. Cylinder 32 includes an inclined surface 42.

In operation, compressed air is supplied to air cylinder 32 via air line 34. The operator positions bucking bar device 30 so that bucking bar 36 is positioned adjacent to a rivet buck tail. When the rivet is hammered, the buck tail is compressed or deformed by its contact with bucking bar 36. The forces resulting from interaction between the rivet and bucking bar 36 cause bucking bar 36 to vibrate and move inward within air cylinder 32. These forces are damped by the compressed air and by the allowed relative movement between bucking bar 36 and air cylinder 32. As a result, the forces acting on the operator holding bucking bar device 30 during bucking operations are also damped.

Although a bucking bar sleeve is described below in the context of bucking bar device 30, such sleeve can be used in connection with many different bucking bar devices and is not limited to use with any one particular bucking bar device. In addition, the described bucking bar sleeve is configured to engage (e.g., retrofit) to an existing bucking bar device, and it is contemplated that the sleeve, or at least the sleeve functionality, could be integrated into such device and its components at the time of original assembly.

Figure 3:
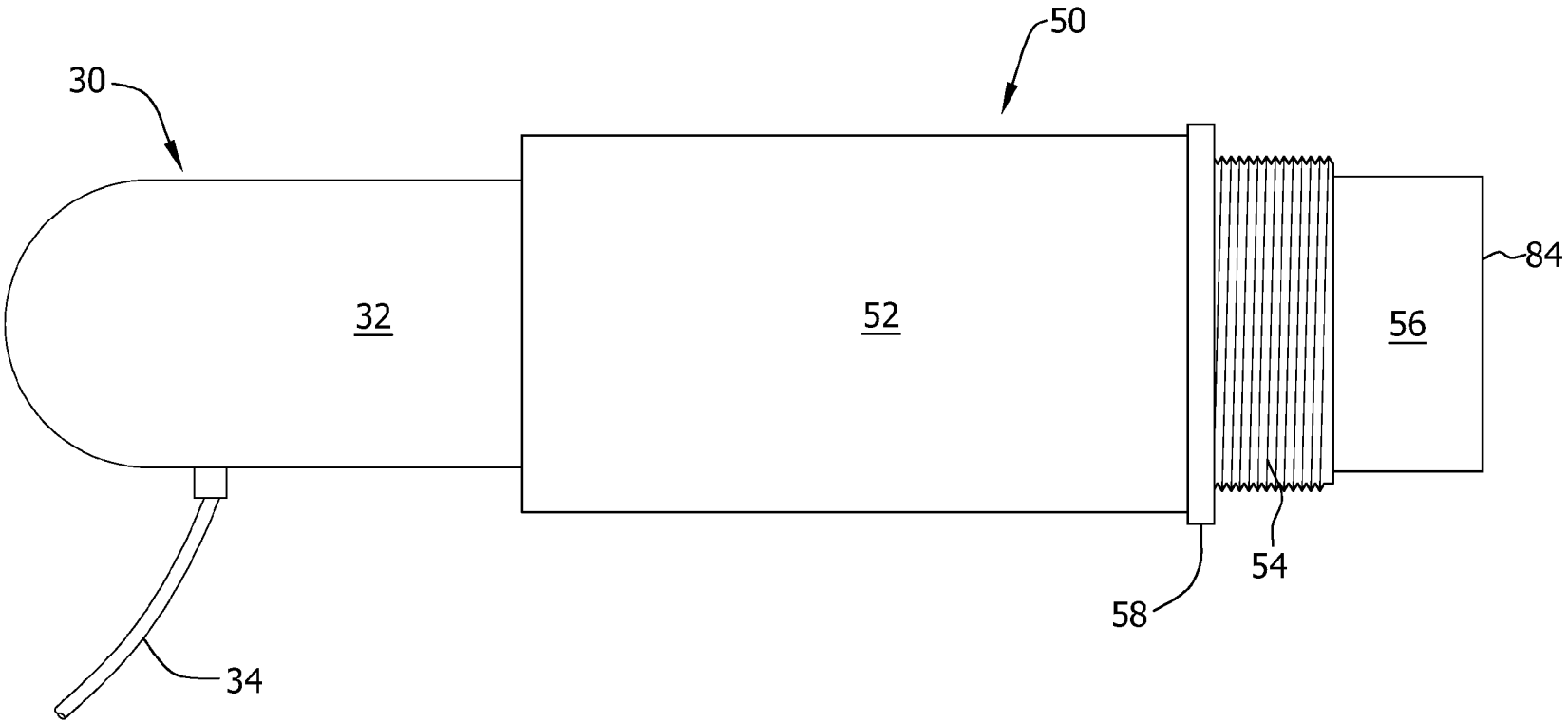
FIG. 3 is a side view of an air damped bucking bar including a bucking bar sleeve.

More specifically, FIG. 3 is a side view of air damped bucking bar device 30 including a bucking bar sleeve 50. As shown in FIG. 3, sleeve 50 is positioned so that bucking bar 36 (not visible in FIG. 3) extends within sleeve 50. Specifically, bucking bar sleeve 50 includes a cylinder engaging sleeve member 52 sized to at least partially slide over and mate with cylinder 32. Cylinder engaging sleeve member 52 is sized so that bucking bar 36 can extend within and through cylinder engaging sleeve member 52.

An intermediate sleeve member 54 is inserted into, and is in threaded engagement with, cylinder engaging sleeve member 52. Intermediate sleeve member 54 is sized so that bucking bar 36 can extend within and through intermediate sleeve member 54.

A non-marring sleeve member 56 is press, or slip, fit into intermediate sleeve member 54. Bucking bar 36 is positioned so that bar 36 interacts with non-marring sleeve member 56 during a riveting operation, as described below in more detail.

A ring 58 is threadedly engaged to intermediate sleeve member 54. Specifically, ring 58 has internal threads that mate with threads on intermediate sleeve member 54. As described below in more detail, ring 56 facilitates securing intermediate sleeve member in position relative to cylinder engaging sleeve member 52 and the bucking bar 36 (shown in FIG. 2).

Figure 4:
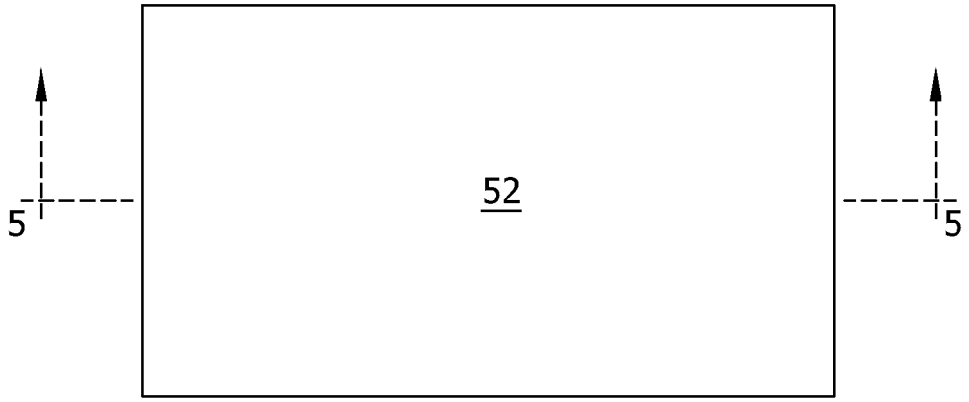
FIG. 4 is a side view of a first sleeve member.
Figure 5:
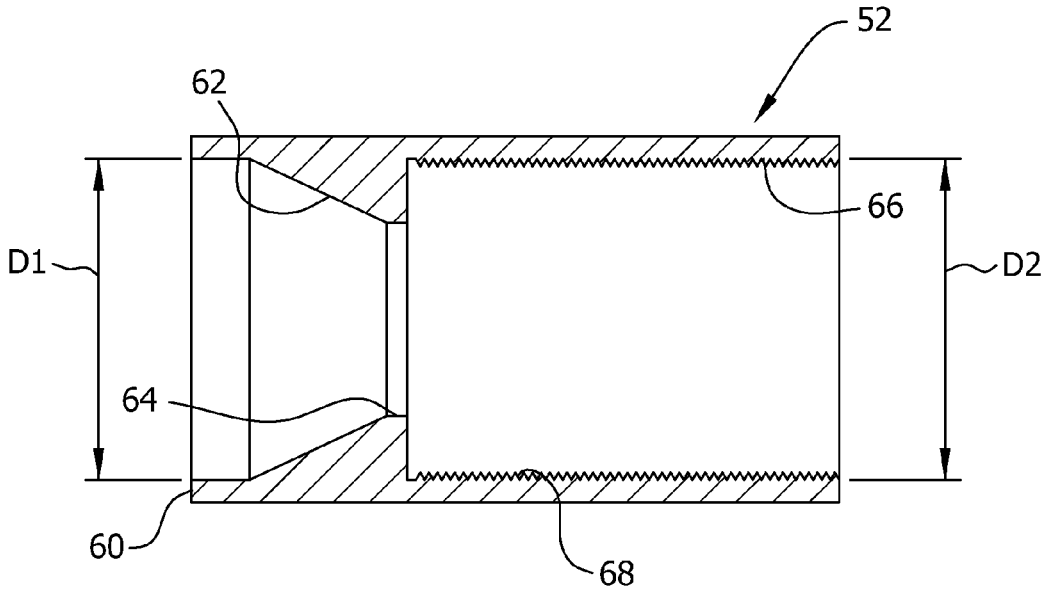
FIG. 5 is a cross sectional view through line 5-5 of first sleeve member shown in FIG. 4.

FIG. 4 is a side view of cylinder engaging sleeve member 52, sometimes referred to herein as first sleeve member. FIG. 5 is a cross sectional view through line 5-5 of first sleeve member 52 shown in FIG. 4. Referring to FIGS. 4 and 5, an end 60 of sleeve member 52 that engages cylinder 32 has an internal diameter D1 sized so that at least a portion of sleeve member 52 extends over and into contact with cylinder 32. Internal inclined surface 62 is sized to match, i.e., mate with, inclined surface 42 of cylinder 32.

An opening 64 within first sleeve member 52 is sized to permit the shaft coupled to the bucking bar to extend therethrough. In addition, an internal diameter D2 of sleeve member 52 is selected so that the bucking bar can extend through and move within sleeve member 52. Threads 66 are on an inner surface 68 of sleeve member 52. First sleeve member can be fabricated from many different materials, and in one embodiment, is fabricated from 6xxx series aluminum.

Figure 6:
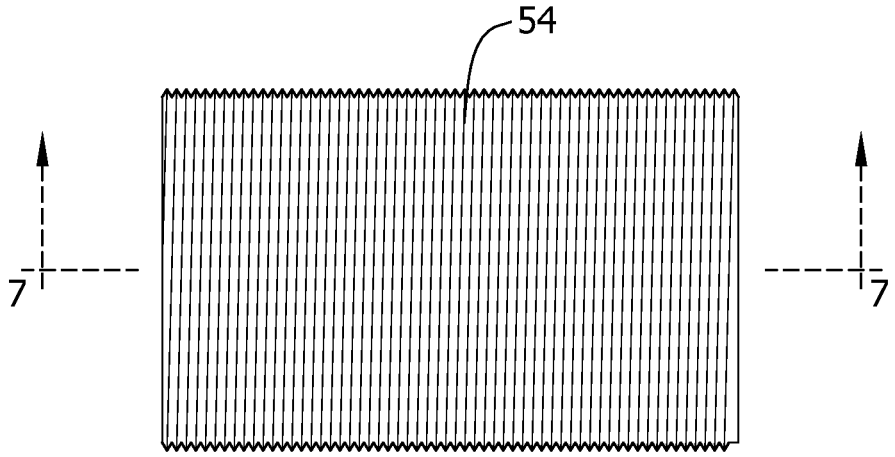
FIG. 6 is a side view of a second sleeve member.
Figure 7:
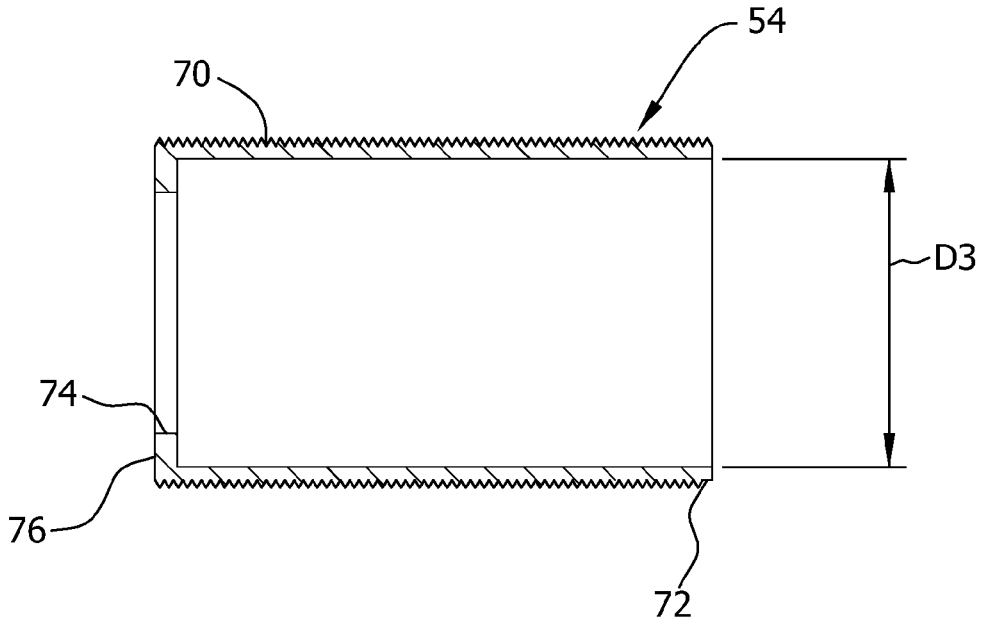
FIG. 7 is a cross sectional view through line 6-6 of second sleeve member shown in FIG. 6.

FIG. 6 is a side view of intermediate sleeve member 54, sometimes referred to herein as second sleeve member. FIG. 7 is a cross sectional view through line 6-6 of second sleeve member 54 shown in FIG. 6. Referring to FIGS. 6 and 7, intermediate sleeve member 54 has threads 70 along an entire length of an outer surface 72. Threads 70 are sized to engage internal threads 66 of cylinder engaging sleeve member 52. Also, inner diameter D3 of intermediate sleeve member 54 is sized so that the bucking bar can extend within and through intermediate sleeve member 54. An opening 74 at end 76 of intermediate sleeve member 54 is sized to permit shaft 38 coupled to bucking bar 36 extend therethrough. Second sleeve member 54 can be fabricated from many different materials, and in one embodiment, is fabricated from cold rolled steel.

Figure 8:
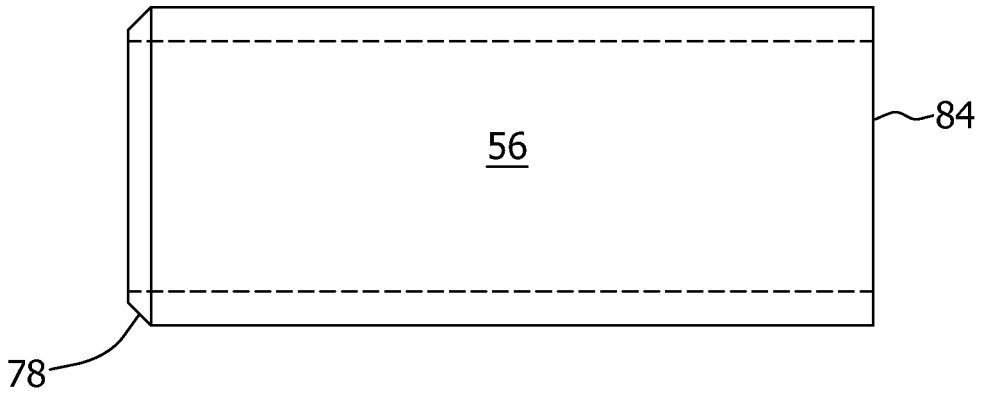
FIG. 8 is a side view of a third sleeve member.
Figure 9:
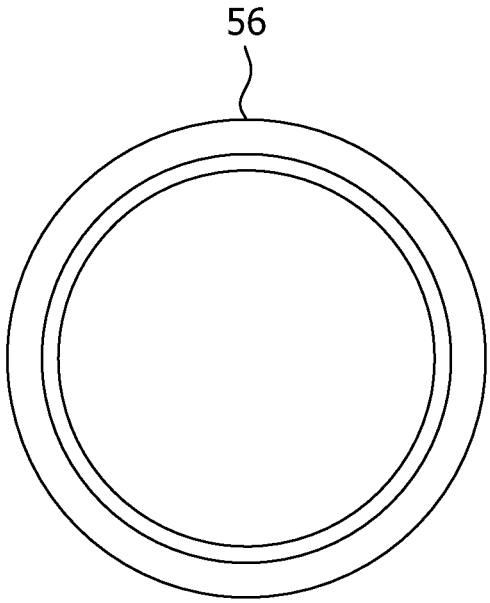
FIG. 9 in an end view of the third sleeve member shown in FIG. 8.

FIG. 8 is a side view of non-marring sleeve member 56, sometimes referred to herein as third sleeve member. FIG. 9 is an end view of third sleeve member 56 shown in FIG. 8. Third sleeve member 56 is press, or slip, fit into intermediate sleeve member 54. An end 78 of sleeve member 56 is tapered to facilitate insertion of sleeve member 56 into intermediate sleeve member 54. An adhesive, such as glue, can be used to facilitate securing third sleeve member 56 within intermediate sleeve member 54. Third sleeve member 56 can be fabricated from many different materials, and in one embodiment is 1¼" schedule 40 PVC pipe. Bucking bar 36 is positioned so that bar 36 interacts with non-marring sleeve member 56 during riveting operations, as described below.

Figure 10:
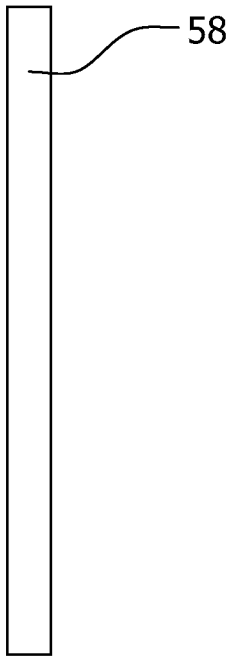
FIG. 10 is a side view of a ring.
Figure 11:
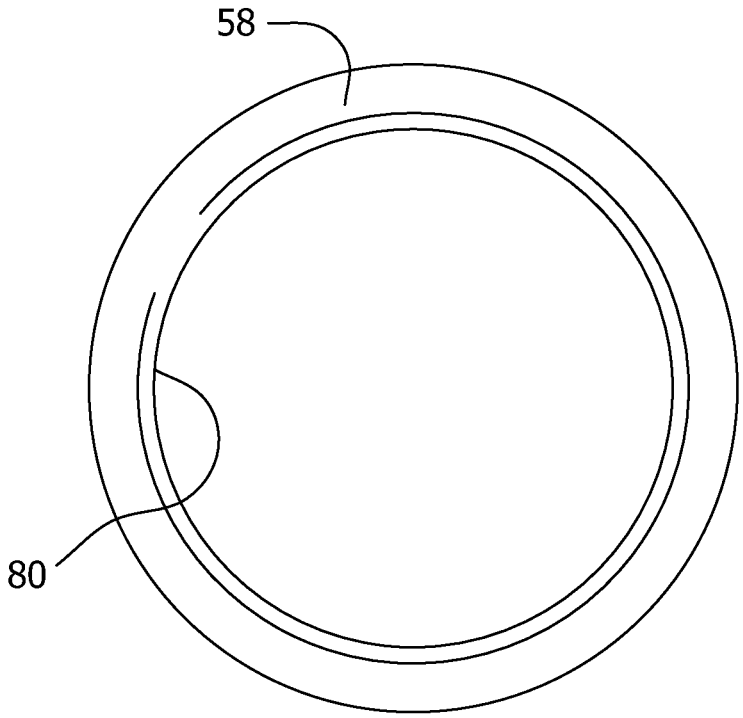
FIG. 11 is an end view of the ring shown in FIG. 10.

FIG. 10 is a side view of ring 56, and FIG. 11 is an end view of ring 56 shown in FIG. 10. Ring 56 includes internal threads 80, and is configured to threadedly engage to intermediate sleeve member 54, as described below in more detail.

To assemble bucking bar sleeve 50, and in one example embodiment with respect to the above described Atlas Copco bucking bar device 30, bucking bar 36 is removed from engagement with air cylinder 32 and first sleeve member 52 is positioned so that inclined surface 62 mates with cylinder inclined surface 42. Second sleeve member 54 is then threadedly engaged to first sleeve member 52. Bucking bar shaft 38 is then inserted through first and second sleeve member aligned openings 64 and 74, and is engaged to air cylinder 32. Third sleeve member 56 is inserted into second sleeve member 54, and is held in place by the tight fit, or an adhesive can be used.

Generally, bucking bar 36 has a flat-surfaced, round, impact face 82, sometimes referred to as a reference surface. Non-marring sleeve member 56 is engaged by bucking bar face 82, and sleeve member 56 extends beyond face 82 and second sleeve member 54. The position of non-marring reference surface 84 can be adjusted in or out (relative to the bucking bar) and then locked into place (by securing ring 58 to second sleeve member 54 and tightening ring 58 against first sleeve member 52) to facilitate assuring a desired amount of recess of impact face 82.

More specifically, and to secure two parts together, non-marring reference surface 84 is adjusted and locked in place as described above to maintain recessed impact face 82 of bucking bar 36 a desired distance from the surface of the part when non-marring reference surface 84 contacts the part. The operators then compress the parts together using non-marring reference surface 84 of sleeve 50 on one side of the compressed parts, and a rivet gun on the other side of the compressed parts.

Figure 12:
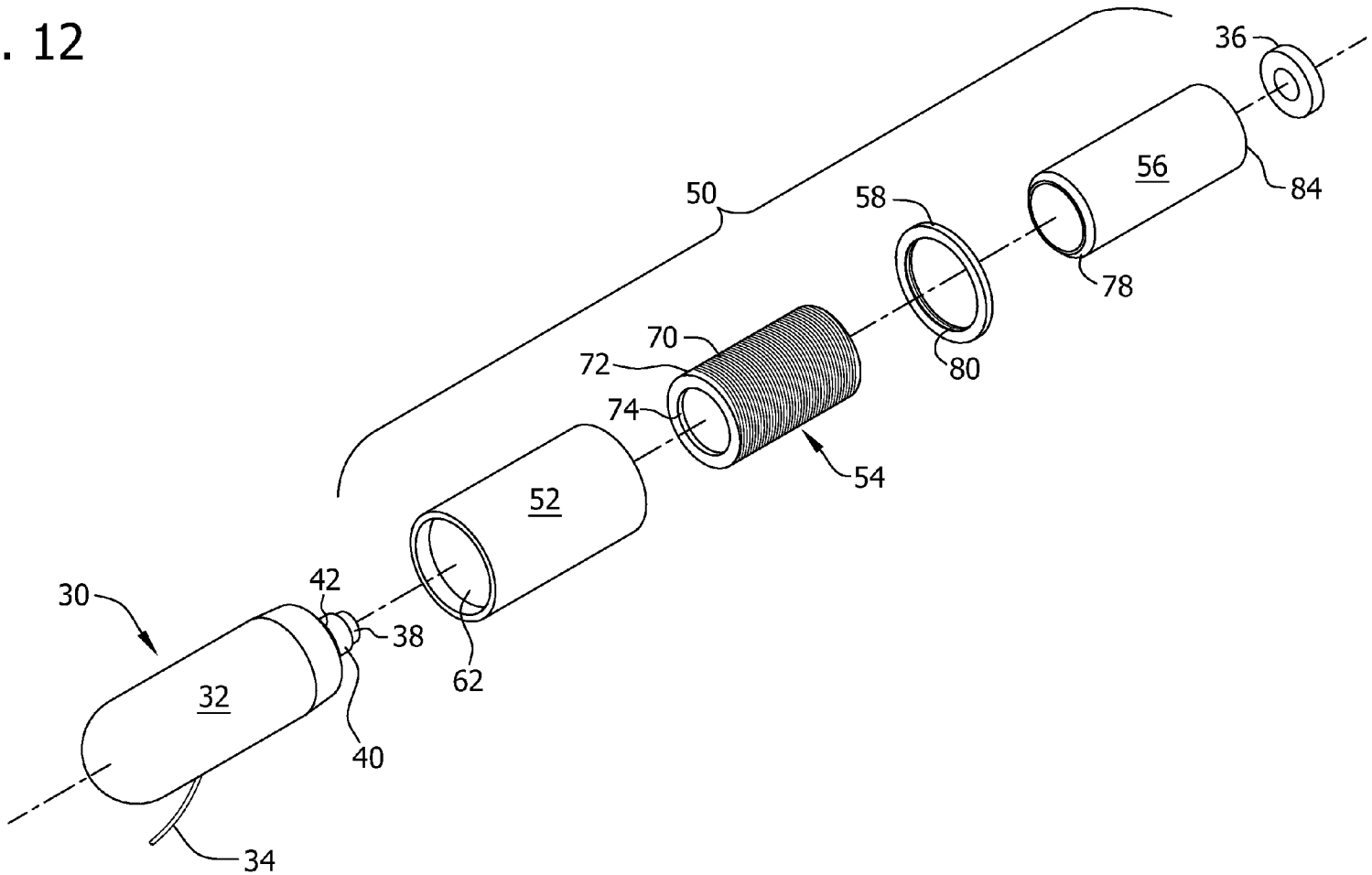
FIG. 12 is an exploded view of the air damped bucking bar and bucking bar sleeve.

FIG. 12 is an exploded view illustrating the components of the air damped bucking bar 30 and bucking bar sleeve 50 both described herein.

Figure 13:
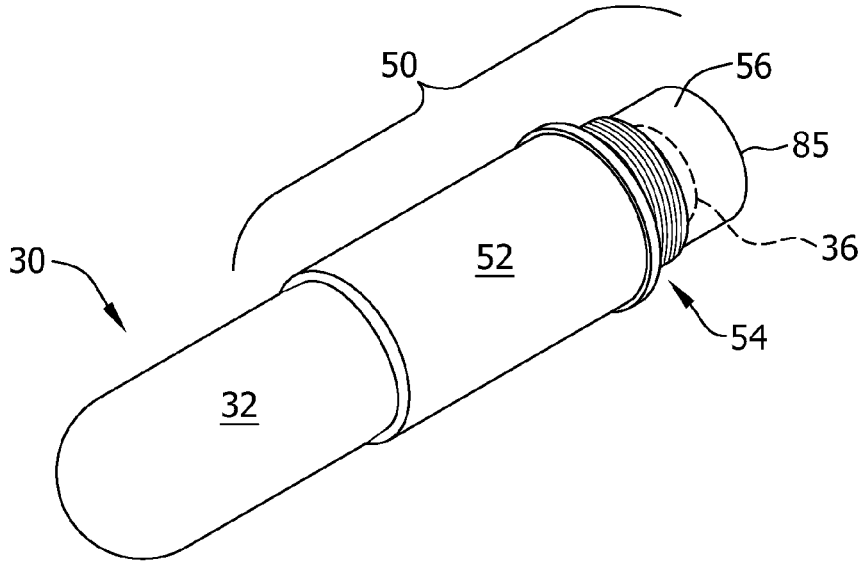
FIG. 13 is an illustration of the air damped bucking bar and bucking bar sleeve of FIG. 12 in an assembled configuration.

FIG. 13 is an illustration of the air damped bucking bar 30 and bucking bar sleeve 50 of FIG. 12 in an assembled configuration, which illustrates a position of bucking bar 36 with respect to sleeve member 56.

Figure 14:
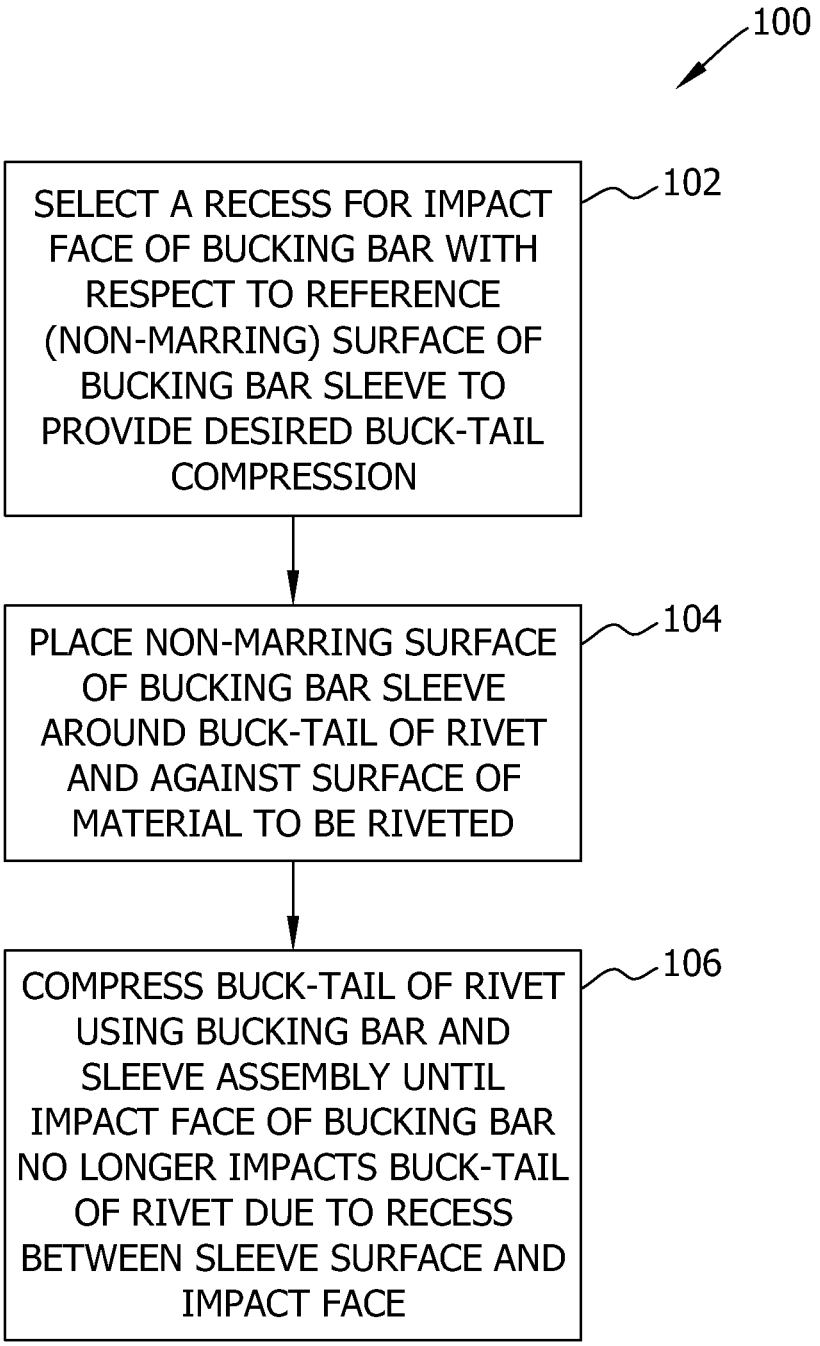
FIG. 14 is a flowchart describing the process of installing a rivet using a bucking bar sleeve operatively attached to a bucking bar device.

The size of the buck tail is controlled by the amount of recess of impact face 82 of bucking bar 36 relative to non-marring reference surface 84 of device 50. Once the buck tail is compressed sufficiently so that it no longer contacts recessed impact surface 82, the buck tail will not be further compressed. The rivet should therefore have the desired size and shape. This process is further described by the flowchart 100 of FIG. 14. For installation of a rivet, an appropriate recess is selected 102 between the impact face 82 of the buck bar 36 and the reference (non-marring) surface 84 of the bucking bar sleeve 50, where the selected 102 recess will provide a desired buck tail compression. The non-marring surface 84 of the bucking bar sleeve 50 is then placed 104 around the buck tail of the rivet to be set and against the surface of the material to be riveted. The buck tail of the rivet is then compressed 106 using the bucking bar 30 and sleeve 50 assembly until the impact face 82 of the bucking bar 36 no longer impacts the buck tail of the rivet as described above.

As explained above, the bucking bar sleeve facilitates assuring the desired compression of a rivet buck tail during a riveting operation, avoiding formation of gaps between parts, and providing bar balance and vibration control for operators. More particularly, the sleeve limits the degree of compression of the buck tail, and also facilitates an even compression across the end of the rivet. The sleeve therefore removes at least some dependency on the skill and experience of the operator, and facilitates avoiding variation and rework.

While the disclosed components and methods have been described in terms of various specific embodiments, those skilled in the art will recognize that the components and methods can be practiced with modification within the spirit and scope of the claims.

What is claimed is:

1. A bucking bar device for use in riveting parts together, said device comprising:

a bucking bar; and a sleeve positioned so that said bucking bar extends within said sleeve, one end of said sleeve configured to be positioned adjacent to at least one of the parts, said sleeve comprising a first sleeve member, a second sleeve member in threaded engagement with said first sleeve member, and a third sleeve member at least partially inserted into said second sleeve member, wherein the bucking bar extends within said first and second sleeve members.

2. The bucking bar device of claim 1 further comprising an air cylinder coupled to said bucking bar.

3. The bucking bar device of claim 1 wherein said sleeve comprises a non-marring sleeve member comprising a reference surface to limit compression of a buck tail.

4. The bucking bar device of claim 3 wherein said non-marring sleeve member has a cylindrical cross sectional shape and is configured to encircle portion of a rivet when pressed against the part.

5. The bucking bar device of claim 1 wherein said first sleeve member comprises a threaded inner surface, and said second sleeve member comprises a threaded outer surface.

6. The bucking bar device of claim 1 wherein said third sleeve member comprises a non-marring surface.

7. The bucking bar device of claim 1 further comprising a ring threadedly engaged to said second sleeve member and configured to be tightened against said first sleeve member.

8. The bucking bar device of claim 1 wherein said bucking bar comprises an impact face, and said third sleeve member comprises a non-marring reference surface, and wherein a distance between said impact face and said reference surface is adjustable.

9. A sleeve for use with a bucking bar device including a bucking bar, said sleeve comprising:

a cylinder engaging sleeve member having threads on an internal surface;

an intermediate sleeve member having threads on an outer surface, said intermediate sleeve member in threaded engagement with said cylinder engaging sleeve member;

a ring having threads on an internal surface, said ring configured to be threadedly engaged to said intermediate sleeve member and tightened against said cylinder engaging sleeve member; and a non-marring sleeve member at least partially inserted into said intermediate sleeve member and extending therefrom.

10. The sleeve of claim 9 wherein said non-marring sleeve member comprises a non-marring reference surface and the bucking bar has an impact face.

11. The sleeve of claim 10 wherein the bucking bar extends within said cylinder engaging sleeve member and said intermediate sleeve member.

12. The sleeve of claim 10 wherein a distance between said non-marring reference surface and said bucking bar impact face is adjustable.

13. A bucking bar device for use in riveting parts together, said device comprising:

a bucking bar; and a sleeve positioned so that said bucking bar extends within said sleeve, one end of said sleeve configured to be positioned adjacent to at least one of the parts, said sleeve comprising a first sleeve member, a second sleeve member in threaded engagement with said first sleeve member, a ring in threaded engagement with said second sleeve member and configured to be tightened against said first sleeve member, and a third sleeve member at least partially inserted into said second sleeve member.

14. A bucking bar device for use in riveting parts together, said device comprising:

a bucking bar comprising an impact face; and a sleeve positioned so that said bucking bar extends within said sleeve, one end of said sleeve configured to be positioned adjacent to at least one of the parts, said sleeve comprising a first sleeve member, a second sleeve member in threaded engagement with said first sleeve member, and a third sleeve member comprising a non-marring reference surface, said third sleeve member at least partially inserted into said second sleeve member, wherein a distance between said impact face and said reference surface is adjustable.

* * * * *